US005727872A

United States Patent [19]

Liou

[11] Patent Number: 5,727,872

[45] Date of Patent: Mar. 17, 1998

[54] DECORATIVE LAMP SOCKET TO BE CLIPPED ON A FIGURATIVE FIXTURE

[76] Inventor: Ching-Chong Liou, No. 4, alley 16, Kuang-Hua S. St., Hsin-Chu City, Taiwan

[21] Appl. No.: 788,049

[22] Filed: Jan. 23, 1997

[51] Int. Cl.[6] ..... F21P 1/021

[52] U.S. Cl. ..... 362/252; 362/249; 362/806

[58] Field of Search ..... 362/123, 249, 362/250, 252, 396, 806, 808

[56] References Cited

U.S. PATENT DOCUMENTS 2,453,695 11/1948 Belling ..... 362/396

5,526,246 6/1996 Liou ..... 362/252

*Primary Examiner*—Y My Quach

*Attorney, Agent, or Firm*—Bacon & Thomas

[57] ABSTRACT

A decorative lamp socket to be clipped on a figurative fixture, in which one end of the socket for mounting bulb has two symmetrical arm plates extended in one direction from one side of the socket; both ends of the arm plates are bent into hook parts facing each other oppositely; the inner surface of each hook part has a curved surface to be in close contact with the figurative fixture; the two hook parts form into an opening, with which the socket can be pressed to clip on a metal rod of the figurative fixture easily.

1 Claim, 3 Drawing Sheets

DECORATIVE LAMP SOCKET TO BE CLIPPED ON A FIGURATIVE FIXTURE

BACKGROUND OF THE INVENTION

1. Field of the Invention

This invention relates to a decorative lamp, and particularly to a decorative lamp having a socket structure able to clip on a figurative fixture.

2. Description of the Prior Art

In the conventional decorative lamp string for Christmas, it usually comprises two or more than two power-supply wires twisted together to connect a series of sockets to form into a lamp string, in which the sockets are not properly fixed in place, and then the sockets are subject to swinging or being in random pendent condition.

In the conventional figurative fixture for a lamp string for a given festival, the figurative fixture is usually made of a metal to bent into a form or figure as desired, and a lamp string having a plurality of sockets is mounted around the figurative fixture; generally, the power-supply wires and the figurative fixture are not fastened together properly; in that case, the lamp string is subject to separating from the figurative fixture. Some part of such lamp strings is fastened in place with thread or the like, but the sockets and the power-supply wires are still in a swinging and pendent condition at random.

In another conventional lamp string, such as U.S. Pat. No. 4,802,072, it is a direction fixture for decorative lamp series comprising a socket for a bulb, wires connected to said socket and a retaining ring attached to said socket, said retaining ring being provided with a notch extending longitudinally of the socket with the wires that are connected to said socket being positioned and retained in said socket so as to fixed said socket in a desired orientation and wherein said retaining ring has an outer face which is in registry with an end rim of said socket. In the aforesaid patent, the sockets and the power-supply wires are fastened together by means of a retainer so as to prevent from causing a random condition between the sockets and the power-supply wires. After such lamp string is mounted on a figurative fixture, it is fastened in place with cord or the like.

SUMMARY OF THE INVENTION

The prime object of the present invention is to provide a lamp socket structure, in which one end of the socket for mounting bulb has two symmetrical arm plates each extended in one direction from one side of the socket; both ends of the arm plates are bent into hook parts facing each other oppositely; the inner surface of each hook part has a curved surface to be in close contact with the figurative fixture; the two hook parts form into an opening, with which the socket can be pressed to clip on a metal rod of the figurative fixture easily.

Another object of the present invention is to provide a lamp socket structure, in which the curved surface of the socket and the inner surfaces of the two arm plates form into two end angles respectively; after the socket is pressed and clipped on the metal rod, such end angles are used as passages to receive and position the power-supply wires.

Still another object of the present invention is to provide a lamp socket structure, in which both ends of the two arm plates are bent inwards to form into two hook parts; the inner side of each hook part has a curved surface; as soon as the socket is pressed and clipped on the metal rod of the figurative fixture, the curved surfaces of the arm plates will hold the metal rod closely to prevent both of them from being separated un-intentionally.

DETAILED DESCRIPTION OF THE PREFERRED EMBODIMENT

Figure 1:
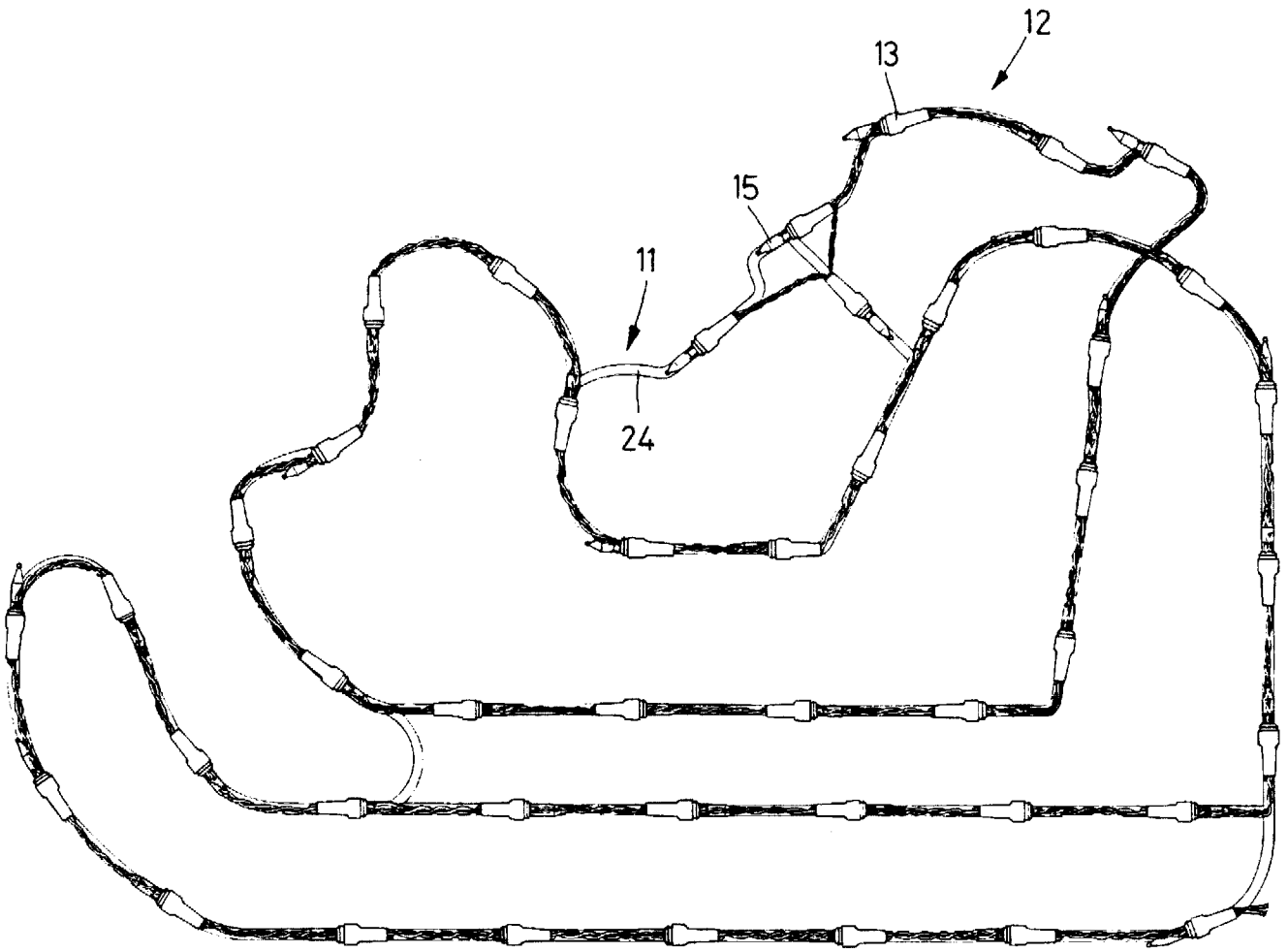
FIG. 1 is a plane view of an embodiment of a figurative lamp string and fixture according to the present invention.
Figure 2:
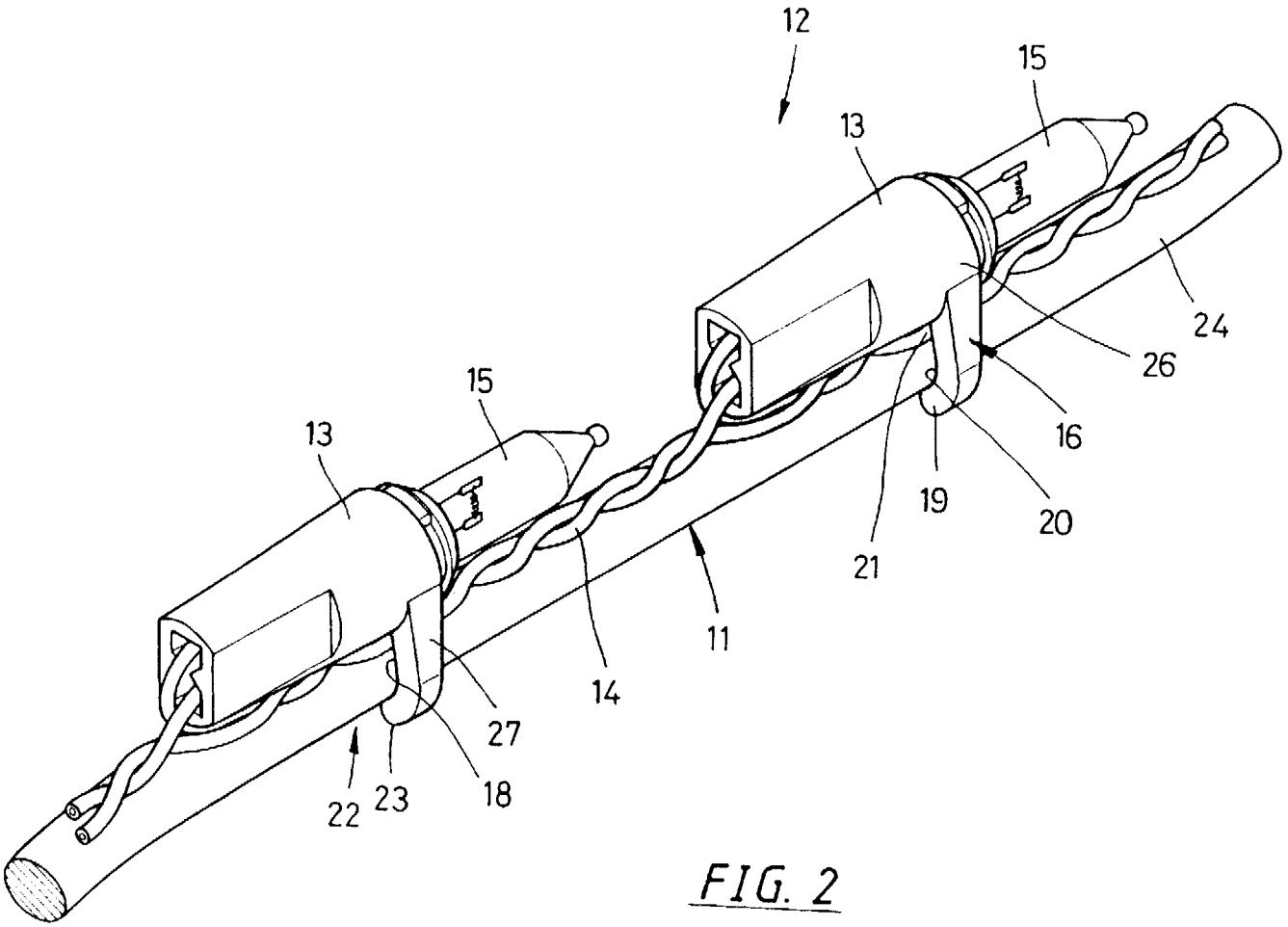
FIG. 2 is a perspective view of the present invention, showing the sockets mounted on the figurative fixture thereof.
Figure 4:
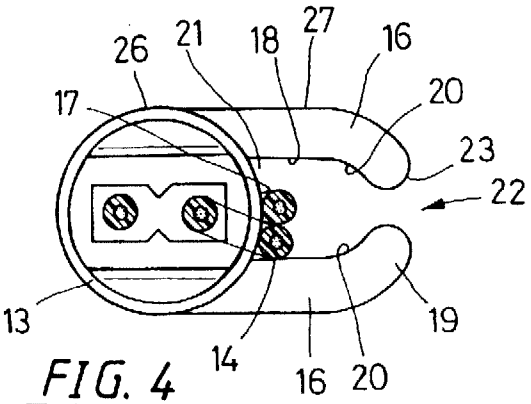
FIG. 4 is a plane view of the present invention, showing the relation between the socket and the power-supply wires thereof.

This invention relates to a decorative lamp socket clipped on a figurative fixture made of metal; referring to FIG. 1, the figurative fixture 11 is made of a metal; the figurative fixture may symbolize a person or scene as desired on a particular festival by using the metal rod 24 to form into such figure. The figurative fixture 11 is usually made of a plurality of metal rods to be bent or welded into a form, and each metal rod has a diameter ranging from four to six millimeters. Before the figurative fixture 11 being mounted on a wall, the sockets 13 of the lamp string 12 are fastened on the metal rods of the figurative fixture 11. By means of the short distance among the sockets 13, the bulbs 15 of the lamp string will show a given figurative symbol upon electric power thereof being turned on.

Referring to FIGS. 1 to 5, the sockets 13 of the lamp string 12 are connected in series by using two or more than two power wires twisted together, and the sockets 13 are connected at a regular space one another as desired. As shown in the aforesaid figures, the power wires 14 include two wires twisted together, in which one wire is used to connect the sockets 13 in series, while the other wire is twisted with the first wire.

The socket 13 to be clipped on the metal rod 24 has two curved surfaces 26, from which two symmetrical arm plates 16 extended to one side of the socket 13 in parallel; each arm plate 16 has a hook part 19 on the outer end thereof, and the outer surface of two hook parts 19 are formed into curve-shaped surfaces 23 respectively; the two hook parts 19 form into an opening 22. Each arm plate 16 has a suitable thickness; the outer surface 27 of the arm plate and the curved surface 26 of the socket 13 are connected in tangential relation. The curved surface 17 of the socket 13 and the inner surfaces 18 of the two arm plates 16 form into two end angles 21 respectively. The inner side of each hook part 19 is furnished with a curved surface 20 to be in close contact with the metal rod 24; the end of each hook part 19 is formed into a curve extended to the opening 22. Since the two arm plates 16 on the socket 13 have a given resilience, they can clip on the metal rod 24 firmly, and the opening 22 of the two arm plates 16 and the curved shapes thereof enable the two arm plates 16 to clip on the metal rod 24 exactly, i.e., the metal rod can easily be guided into the space formed with the hook parts 19.

Before the lamp string 12 being clipped on the figurative fixture 11, the two power-supply wires 14 twisted have to be laid in a space between the arm plates 16 (as shown in FIG.

Figure 5:
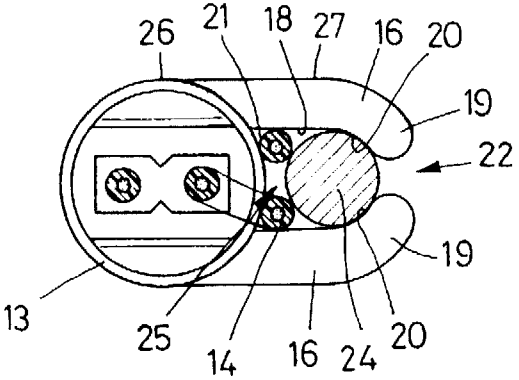
FIG. 5 is a plane view of the present invention, showing the relation between the socket and the metal rod thereof.
Figure 3:
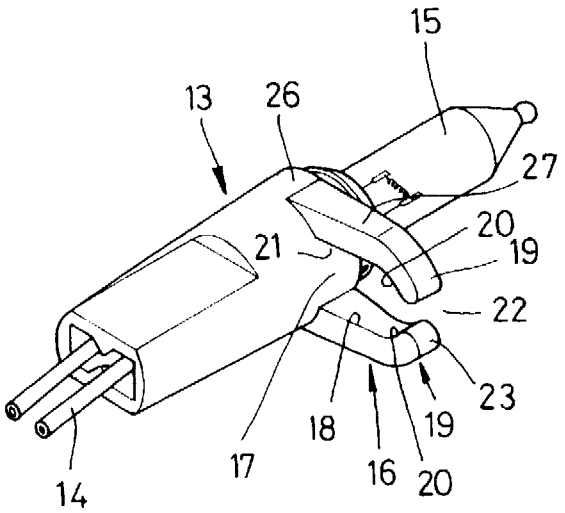
FIG. 3 is a perspective view of a single socket according to the present invention.

4). If there are more than two power-supply wires 14, only the number of wires for connecting two sockets are laid in such space, and the rest wires are laid outside. The two end angles 21 formed between the inner surfaces 18 and the curved surface 17 of the socket 13 will be used as the passage 25 of the two power-supply wires 14 upon the socket 13 being clipped on the metal rod 24 (as shown in FIG. 5); in that case, the power-supply wires 14 are pushed in the end angles 21 respectively, i.e., the metal rod 24, the power-supply wire 14 and the hook part 19 of the arm plate 16 are formed into a triangle-shaped contact.

The sockets 13 can easily be clipped on the metal rod 24 in a regular order by means of the opening 22 of the two arm plates 16, the curved surface and the resilience thereof. During clipping the socket 13, the two power-supply wires 14 can easily be separated by a user's finger, i.e., the two power-supply wires 14 being laid in the end angles 21 formed between the inner surface 18 and the curved surface 17 respectively. As soon as the metal rod 24 is guided into the space between the two hook parts 19 of the arm plates 16, the inner surface of the hook parts 19 will be in close contact with the curved surface 20 of the metal rod 24, i.e., being pressed on the outer surface of the metal rod 24 without being separated from each other.

The arm plates 16 on the sockets 13 can be clipped on the metal rod 24 of the figurative fixture 11 one after another; then, the two power-supply wires 14 of the socket 13 will be positioned in the end angles 21 of two arm plates 16 respectively, and the two power-supply wires 14 twisted will be set in the figurative fixture properly in good order. Since there is a rather short distance between two sockets 13, the figurative fixture will show a figurative symbol with the light of the bulbs upon the lamp being lit up.

The present invention has been described with the aforesaid embodiment to point out the features and structure thereof. It is apparent that the present invention has been improved, and is not anticipated by any person skilled in the art; the structure of the present invention is deemed unique.

I claim:

1. A decorative lamp socket to be clipped on a figurative fixture comprising two symmetrical arm plates extended from both sides of said socket, each of said two arm plates extended from a curved surface of said socket; and end of each of said arm plates having a curved hook part, and an end of each of said hook parts having a curve-shaped surface, and an opening being formed with said two curve-shaped surfaces having a suitable distance therebetween; an outer surface of said arm plate being connected with said curved surface of said socket in tangential relation; said curved surface of said socket and inner surfaces of said two arm plates formed into two end angles respectively; said ends of said two arm plates bent inwardly toward each other to form said hook parts respectively; said inner surfaces of said arm plates having two curved surfaces respectively in close contact with a metal rod of said figurative fixture; said socket clipping on said metal rod by means of said opening formed between said two arm plates; two power-supply wires being laid and fastened in said end angles respectively formed between said inner surfaces of said arm plates and said curved surface of said socket, and said inner curved surfaces of said hook parts being in close contact with said metal rod and preventing said socket separated from said metal rod.

* * * * *